US007275974B2

(12) United States Patent
Perry

(10) Patent No.: US 7,275,974 B2
(45) Date of Patent: Oct. 2, 2007

(54) MAGNETIC TOP TOY

(76) Inventor: Michael Clayton Perry, 136 S. Euclid, Oak Park, IL (US) 60302

( * ) Notice: Subject to any disclaimer, the term of this patent is extended or adjusted under 35 U.S.C. 154(b) by 249 days.

(21) Appl. No.: 11/086,499

(22) Filed: Mar. 22, 2005

(65) Prior Publication Data

US 2006/0217029 A1 Sep. 28, 2006

(51) Int. Cl.
*A63H 33/26* (2006.01)

(52) U.S. Cl. ..... 446/138; 446/263; 446/129; 273/109

(58) Field of Classification Search ..... 273/109; 446/263, 138
See application file for complete search history.

(56) References Cited

U.S. PATENT DOCUMENTS

| | | | | |
|---|---|---|---|---|
| 180,573 | A * | 8/1876 | Goodwin et al. | 446/258 |
| 870,146 | A | 11/1907 | Webb | |
| 884,931 | A | 4/1908 | Johansson | |
| 1,322,217 | A | 11/1919 | Anderson | |
| 1,366,535 | A * | 1/1921 | Harrington | 446/263 |
| 1,403,200 | A | 1/1922 | Sandstrom | |
| 2,034,293 | A | 3/1936 | Hacker | |
| 2,818,680 | A | 1/1958 | Borsos | |
| 3,099,105 | A * | 7/1963 | Martinez | 446/138 |
| 3,785,652 | A | 1/1974 | Ghovanloo | |
| 4,031,660 | A * | 6/1977 | Chen | 446/132 |
| 4,290,225 | A | 9/1981 | MacCarthy | |
| D275,582 | S | 9/1984 | MacCarthy | |
| D290,857 | S | 7/1987 | Lohr | |
| D436,383 | S | 1/2001 | Chesler | |

* cited by examiner

*Primary Examiner*—Eugene Kim
*Assistant Examiner*—Urszula M Cegielnik
(74) *Attorney, Agent, or Firm*—Vedder Price Kaufman & Kammholz

(57) ABSTRACT

A wheel-shaped top with magnetic spindles projecting from the body. A circular disc with a beaded rim is mounted on each end of a shaft; the rims of the discs forming a two-rail track encircling the shaft. A handle has two legs attached to opposite ends of the shaft. The spindles are magnetically attached to the two-rail track. The top orbits around the track in response to hand-manipulation of the handle; it is launched from the track when the orbital speed is sufficient to centrifugally separate the spindles from the track to spin on a surface, and can be magnetically retrieved, while spinning, by engagement of the spindles with the shaft, or with one or both of the discs.

10 Claims, 4 Drawing Sheets

MAGNETIC TOP TOY

CLAIM OF PRIORITY PURSUANT TO 35 USC SEC. 120

Applicant claims the benefit of the May 24, 2004 filing date of co-pending application Ser. No. 29/206,018 ("018"). The entire '018 application is incorporated by reference herein.

BACKGROUND OF THE INVENTION

1. Field of the Invention

This invention relates generally to toys of the type that include the combination of (1) a top having a wheeled-shaped body with magnetic spindles projecting in opposite directions from the axis of rotation of the body, and (2) apparatus that can be manipulated to cause the top to spin, or to travel in a particular path dictated by rails, or the like. In some cases, the spinning top may separate from the apparatus to spin on a floor, or other surface.

2. Description of the Prior Art

The prior art discloses top toys that includes combinations of tops having wheel-shaped bodies with wire rails, a spiral track, and the like. Representative prior art U.S. patents in the relevant art are listed on the Information Disclosure Statement filed with this application. Included in the listed prior art patents are tops having a wheel-shaped body with a pair of magnetic spindles projecting from opposite sides of the body at its axis of rotation for securing the top to a pair of rails by magnetic attraction. See, for example, Chen U.S. Pat. No. 4,031,660, issued Jun. 28, 1977, and Chesler U.S. Pat. D436,383 issued Jan. 16, 2001 which also discloses a top with a wheel-shaped body.

SUMMARY OF THE INVENTION

The toy of this invention includes: (1) a top having a wheel-shaped body; an axle mounted in the center of the body with a magnetic spindle at each end projecting from opposite sides of the body; (2) a track component with a pair of spaced discs mounted on a shaft so that the rims of the discs function as an endless, circular, two-rail track enclosing the shaft; and (3) a handle having a pair of legs that straddle the discs and are attached to a respective end of the shaft. The top is attached to the two-rail track by magnetic attraction of the spindles with the rims of the discs. The top orbits the shaft in response to manipulation of the handle. If the speed of the top develops centrifugal force sufficient to overcome the magnetic attraction to separate from the track to spin on a floor or other surface. The operator can retrieve the spinningop by magnetic attraction of a spindle with an end of the shaft, one of the discs, or the two-rail track.

DESCRIPTION OF THE PREFERRED EMBODIMENT

Figure 1:
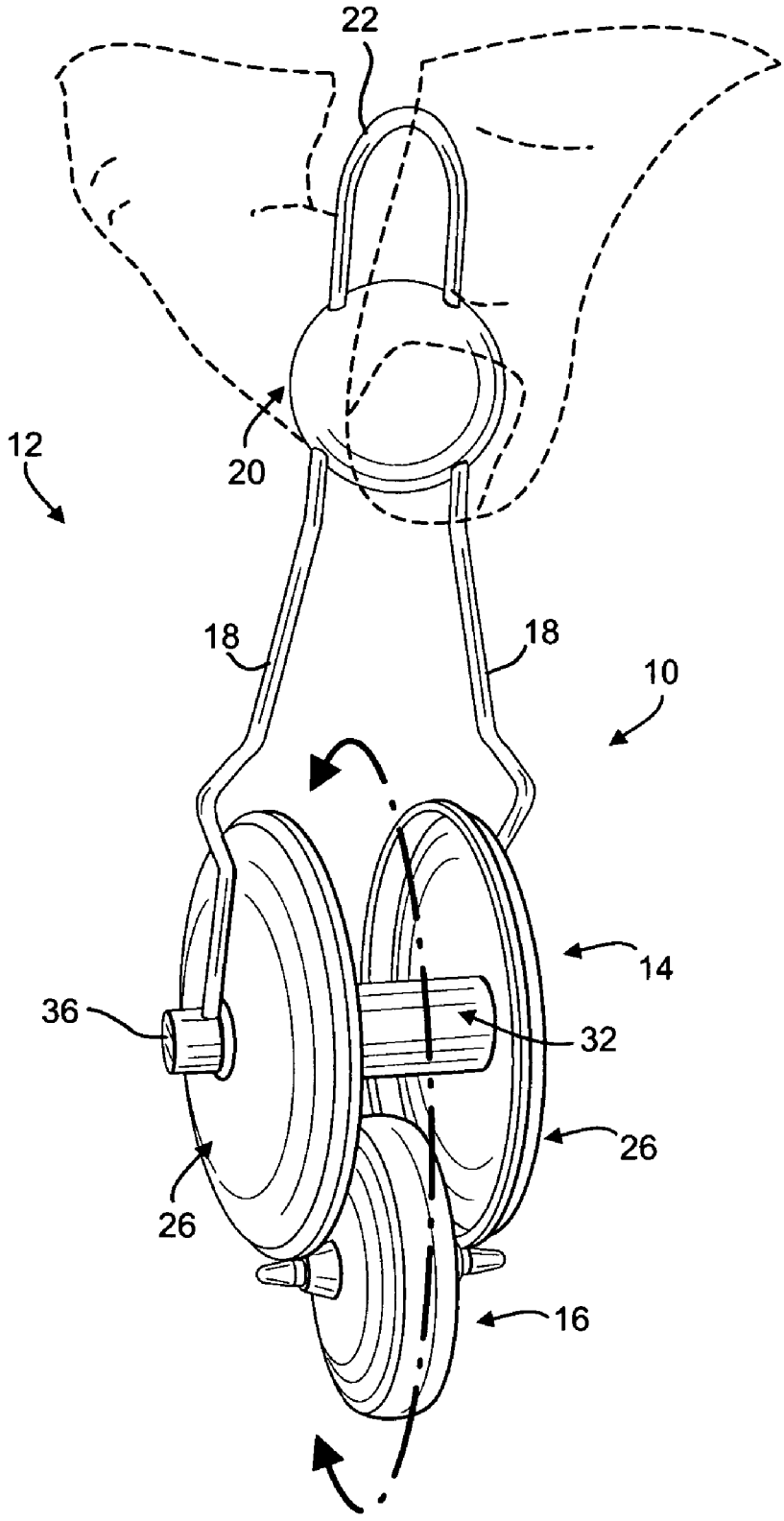
FIG. 1 is a perspective view of the magnetic top toy of this invention, including a track component, a handle component, and a top with a wheel-shaped body attached to the track component by magnetic attraction.
Figure 3:
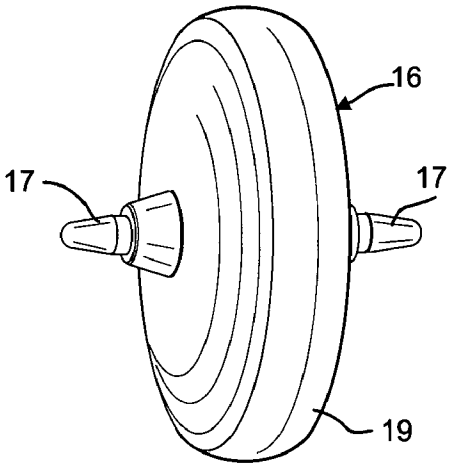
FIG. 3 is a is a perspective view of the top.
Figure 4:
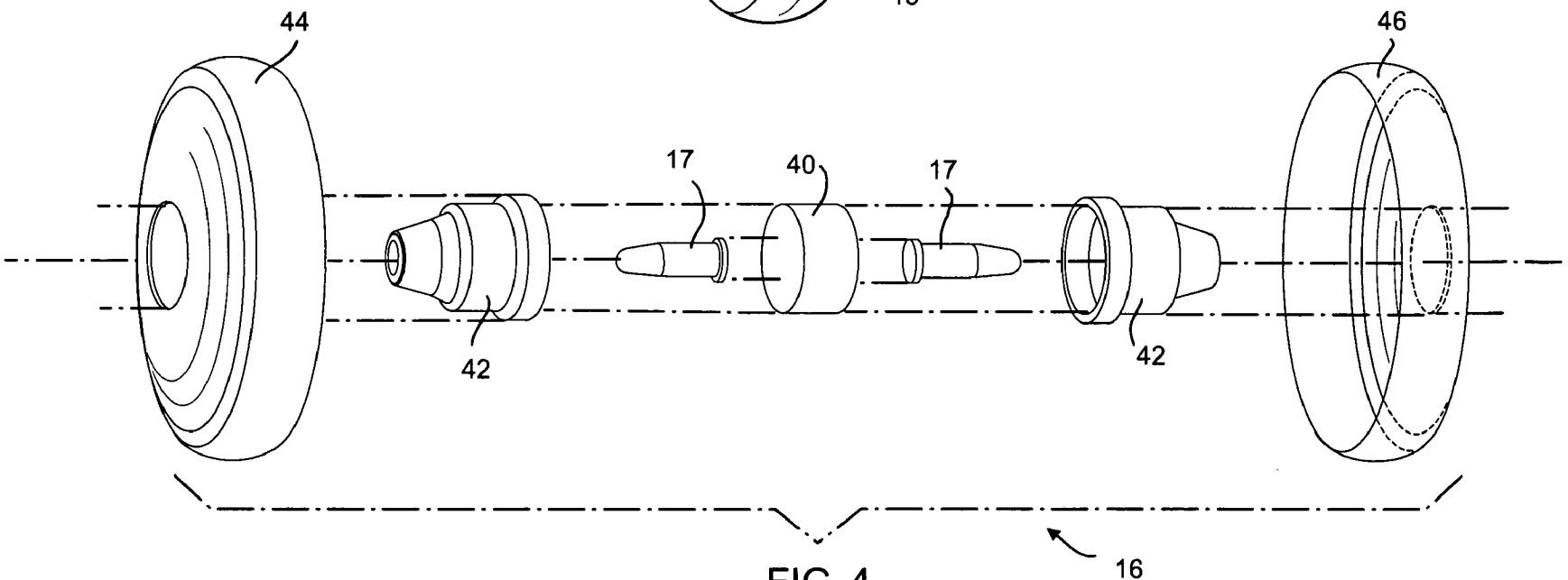
FIG. 4 is an exploded view of the top.
Figure 5:
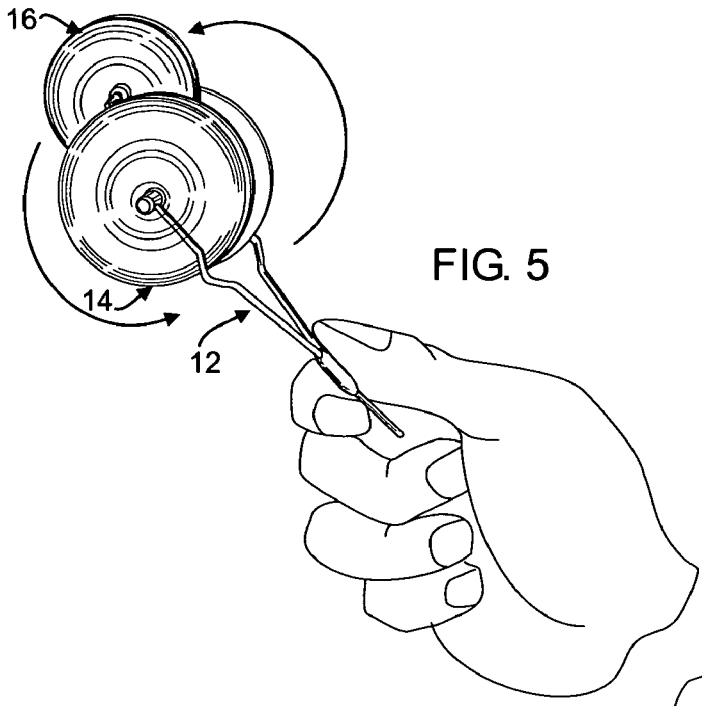
FIG. 5 is a side view of the top orbiting the shaft on the spaced track members.
Figure 6:
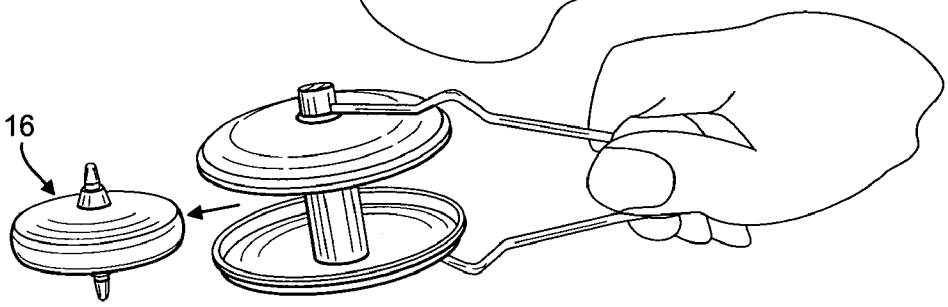
FIG. 6 is a perspective view of the top being centrifugally launched from the track.
Figure 7:
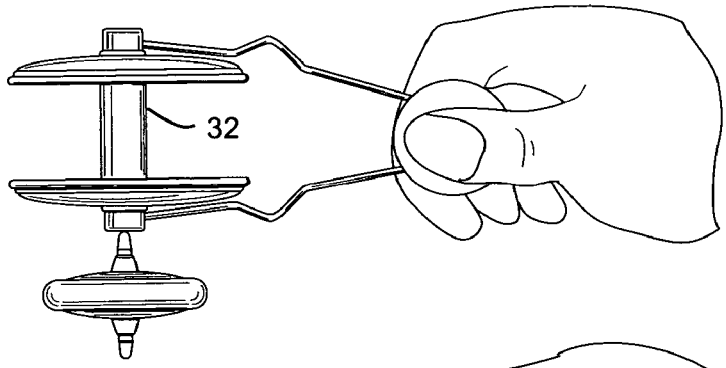
FIG. 7 illustrates retrieval of the spinning top by magnetic attraction of the top to one end of the shaft of the track component.
Figure 8:
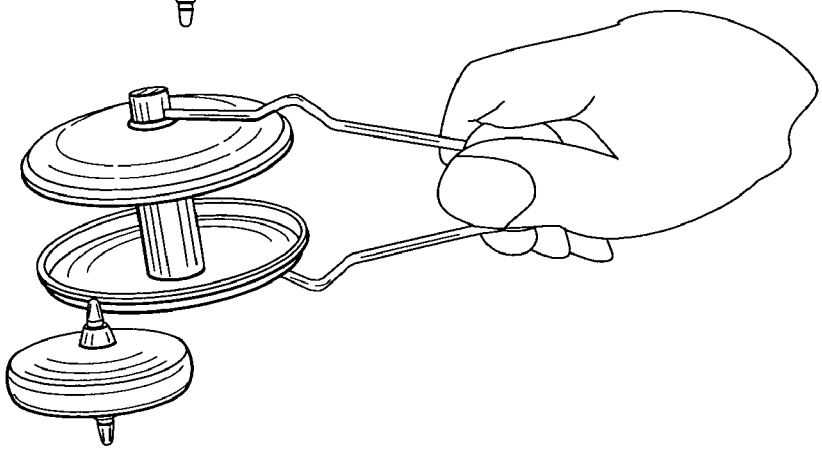
FIG. 8 illustrates retrieval of the spinning top by magnetic attraction of the top to one of the disks of the track component.

In the drawings (FIGS. 1-3), reference numeral 10 designates the assembled toy, which has three components: (1) a top 16; (2) a track component 14; and (3) a handle 12. In the illustrated embodiment (FIGS. 1 and 3), the top 16 has a wheel-shaped body 19. A pair of magnetic spindles 17 project from opposite sides of the body 19 at the rotary axis. common to the body 19 and the spindles 17 (FIGS. 1, 3 and 4).

The track component 14 (FIGS. 1 and 2) includes a shaft 32 with reduced-diameter ends 34. A disk 26 is mounted on each of the reduced ends 34. In the illustrated embodiment, each disk 26 has a concave body with an opening 30 at its center for receiving one of the reduced ends 34 of shaft 32. A beaded rim 28 is formed at the periphery of each of the disks 26.

The disks 26 are mounted on the opposite ends of shaft 32 in mirror-image relationship such that the opposed pair of rims 28 form a two-rail track enclosing shaft 32. In the illustrated embodiment, the rims 28 are circular and concentric with the axis of shaft 32; hence, the top travels in an endless, circular orbit around the axis of shaft 32 as it travels around the two-rail track defined by the spaced rims 28.

Figure 2:
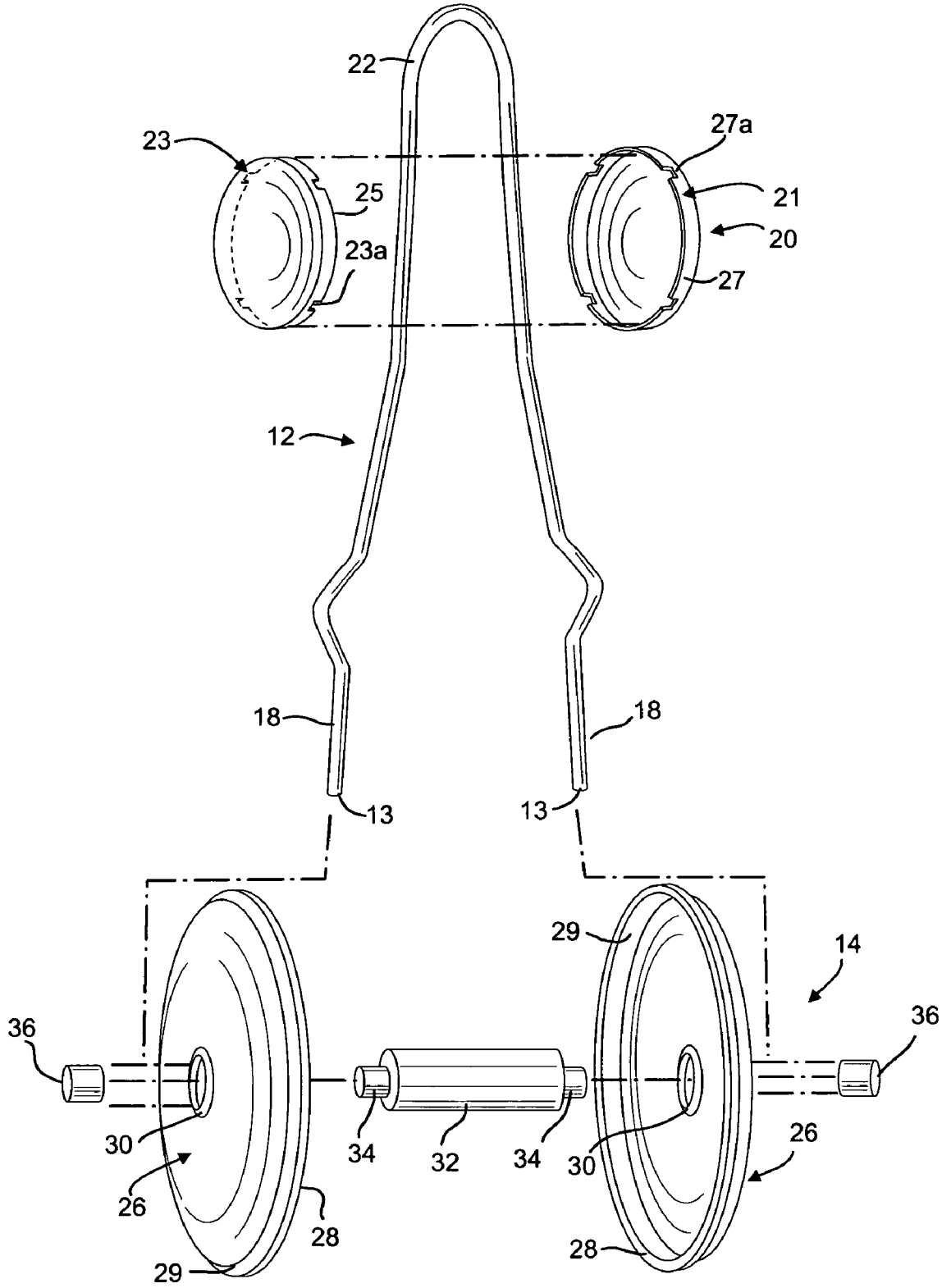
FIG. 2 is an exploded, perspective view of the handle and track components.

The handle 12 (FIGS. 1 and 2) is comprised of a wire member 12 bent at the center to form a curved, u-shaped bight 22 defining the free end of the handle 12, A pair of legs 18 project from the bight 22 and terminate at spaced free ends 13 (FIG. 2). A hole extends diametrically through the cylindrical wall of each end cap 36, as well as the reduced-diameter end portion 34 of shaft 32. The free ends 18*a* of the handle 12 straddle the discs 26 and are received in a respective one of the holes as illustrated in FIGS. 1 and 5-8, and indicated in FIG. 2 by the chain-dotted lines that extend from the free ends 18*a* of legs 18 to a respective one of the end caps 16.

A circular clamp 20 is mounted on both legs 18 of the wire handle 12 (FIGS. 1 and 2) at a location near the bight 22. The clamp 20 is formed by a pair of circular, rimmed disks 21 and 23 (FIG. 2) having cylindrical rims 25 and 27 that project from the peripheries of discs 23 and 21, respectively. The rims 25 and 27 have matched sets of four notches aligned to receive legs 18. Rims 25 and 27 are sized to allow one to fit into the other with a force-fit. Each notch of rim 25 is matched with a notch of rim 27 so as to receive a respective one of the pair of legs 18 as illustrated in FIG. 1. The clamp 20 is used as a gripping member for hand-manipulation of the toy as illustrated in FIG. 1.

The preferred construction of top 16 is shown in FIGS. 3 and 4. The top 16 has a wheel-shaped body 19. A pair of magnetic spindles 17 project from opposite ends of the axle formed by the axle halves 42 illustrated in the exploded view of FIG. 4. The spindles 17 are magnetized by a cylindrical, permanent magnet 40 located between the flat ends of spindles 17 as illustrated in FIG. 4.

When the parts of FIG. 4 are assembled together, the flat ends of spindles 17 are each seated against a respective flat end of magnet 40. The spindles are magnetized by the contact of the flat ends of the spindles with the respective flat ends of magnet 40. When assembled, the pointed ends of spindles 17 project from a respective axle-halve 42 (FIGS. 3 and 4).

While specific embodiments of the invention are illustrated in the drawings and described in the specification, the invention is not limited to the exact construction shown and described. Variations in the construction and arrangement of parts and components are possible without departing from the scope of the invention as defined in the claims.

The invention claimed is:

1. A top toy comprising:

a wheel-shaped top having a body with a pair of magnetic spindles; and a track component made of a material capable of magnetic engagement for supporting the magnetic spindles of the wheel-shaped top, said track component comprising a shaft with a first and a second end, and a pair of disks mounted on opposite ends of the shaft, wherein each disk having a rim disposed in spaced, complementary relationship defining a space with the rim of the other disk to form a two-rail track enclosing said shaft.

2. The toy of claim 1 further comprising a handle having a pair of legs straddling said disks each leg having a opposing ends at a first and a second side, the ends of said legs being attached on a first side to the first and second end of said shaft.

3. The top toy of claim 2 wherein the pair of magnetic spindles projects in opposite directions from said body at its rotary axis to magnetically engage said two-rail track.

4. The top toy of claim 2 in which said handle has a bight portion connecting the ends of said pair of legs at the second side.

5. The top toy of claim 4 in which each rim is circular and concentric with said shaft.

6. The top toy of claim 5 further including a hand grip connecting said pair of legs at a location between the first side and the second side.

7. The top toy of claim 1 further comprising:

a wheel-type top having a magnetic axle of a length sufficient to bridge the space between said pair of rims and wherein the magnetic axle magnetically engages said track component and as a result of the rotation of the wheel-type top around the magnetic axle orbits said shaft.

8. The top toy of claim 7 further comprising:

a handle having a pair of legs straddling said disks; the ends of said legs being secured to the opposite ends of said shaft.

9. The top toy of claim 8 in which said discs are circular and concentric with said shaft.

10. A top toy comprising:

a track component made of a material with magnetic properties having a shaft;

a pair of spaced disks mounted on opposite ends of said shaft;

each disk having a rim enclosing said shaft to form, along with the rim of the other disk on the opposite end, a two-rail track enclosing said shaft; and a top having a wheel-shaped body;

an axle mounted in the center of said wheel-shaped body;

said axle having a pair of magnetic spindles projecting from the opposite ends thereof to magnetically engage said two-rail track and orbit said shaft.

* * * * *